US006034003A

United States Patent [19]

Lee

[11] Patent Number: 6,034,003

[45] Date of Patent: Mar. 7, 2000

[54] ULTRAVIOLET RADIATION PROTECTIVE CLOTHING

[76] Inventor: Kui-Fong Lee, 409 Shell Gate Rd., Alameda, Calif. 94501

[21] Appl. No.: 08/999,343

[22] Filed: Dec. 29, 1997

[51] Int. Cl.[7] ..... D03D 3/00

[52] U.S. Cl. ..... 442/131; 442/59; 442/130; 442/133

[58] Field of Search ..... 442/130, 131, 442/133, 59

[56] References Cited

U.S. PATENT DOCUMENTS

| | | | |
|---|---|---|---|
| 4,339,503 | 7/1982 | Rukavina et al. | 428/412 |
| 5,066,082 | 11/1991 | Longstaff | 359/361 |
| 5,342,610 | 8/1994 | Katoh et al. | 424/59 |
| 5,374,362 | 12/1994 | McFarland | 252/8.6 |
| 5,458,956 | 10/1995 | Shi et al. | 428/229 |

*Primary Examiner*—Helen L. Pezzuto
*Attorney, Agent, or Firm*—Michael I. Kroll

[57] ABSTRACT

The present invention relates to UV-resistant fabric, articles of clothing made from such fabric, and methods of making such fabric. The method includes 1) preparing an aqueous solution of anthraquinone (10) and NaOH (62), 2) immersing the fabric to be treated in the solution (64), 3) heating the solution/fabric mixture (66), 4) adding to the solution/fabric mixture an appropriate reducing agent (68), and 5) rinsing the fabric thus treated with hydrogen peroxide (70). White fabrics can be treated (72) with a conventional bleaching, or whitening, agent. Colored fabrics can contain, as an additional UV-absorbing compound, one of the class of compounds known as melanins, including those formed from the free radical polymerization of compounds derived from the precursor amino acid tyrosine (24), such as 5,6-dihydroxyindole (34).

30 Claims, 8 Drawing Sheets

10

Anthraquinone 12

$C_{14}H_8O_2$ 14 m.w. 208.2 16

24

2-Amino-3-*p*-hydroxyphenylpropanoic acid 26

Tyrosine 28

$C_8H_{11}O_3N$ 30 m.w. 181.2 32

34

5,6-Dihydroxyindole 36

$C_8H_7O_2N$ 38 m.w. 149.2 40

42

Amino-3-mercaptopropanoic acid 44

Cysteine 46

$C_3H_7O_2N$ 48 m.w. 121.2 50

52

1,8-Dihydroxynaphthalene 54

$C_{10}H_8O_2$ 56 m.w. 160.2 58

60

ULTRAVIOLET RADIATION PROTECTIVE CLOTHING

BACKGROUND OF THE INVENTION

1. Field of the Invention

The instant invention relates generally to articles of clothing which have enhanced ultraviolet radiation absorption for protecting the wearer from the deleterious effects of ultraviolet radiation, and more specifically to articles of clothing which have been treated with anthraquinone, melanin or combinations thereof.

Most skin cancers in humans can be categorized as basal cell carcinomas, squamous cell carcinomas or melanomas. Each year in the United States, more than 500,000 people are diagnosed with basal cell carcinomas, 100,000 with squamous cell carcinomas and 30,000 with melanomas. It has been estimated that more than 90% of these skin carcinomas are caused by exposure to ultraviolet (UV) radiation exposure. As a result of ozone depletion in the upper atmosphere, human exposure to UV radiation has been increasing dramatically in recent years, especially in the higher latitudes, where the ozone depletion has been relatively greatest. In Australia, for example, over 100,000 people die each year from skin cancer. Accordingly, it has become more important for people to limit their exposure to UV radiation. This can be accomplished through various means, including the use of sunscreens and UV-resistant articles of clothing.

Sunlight is composed of 66% of infrared light (manifested as heat), 32% visible light, and 2% ultraviolet light (UVL). UVL can be subdivided into ultraviolet A (UVA, wavelength 320–400 nm) and ultraviolet light B (UVB, 290–320 nm). UVB is the main cause of sunburn, with UVA supplementing the effects of UVB on the skin. UVA, having a longer wavelength than UVB, however, can penetrate deeper into the skin. It is believed that UVA like UVB also plays a part in premature skin aging and other skin problems such as skin cancers. With this in mind, it is important for UV-resistant articles of clothing to be resistant to both UVA and UVB radiation.

The degree of protection against UV radiation afforded by clothing is highly variable and depends on a number of factors. One factor is the permeability of the factor. Specifically, a fabric can be made relatively UV-resistant by providing a relatively tight weave or a very high thread count, or by coating the fabric. Both of these approaches greatly reduce or eliminate the apertures in the fabric, thus decreasing UV transmission through the fabric. While this may increase UV protection, it usually produces a material which can be heavy and/or uncomfortable to wear, particularly in hot temperatures when UV radiation is generally highest. Another factor is the UV absorption characteristics of the fabric. The characteristics which are of principal interest are the transmission characteristics of the yarn or fiber, particularly the proportion of UV radiation which is transmitted through or along the fiber or yarn, as opposed to being absorbed or reflected. Accordingly, the present invention concerns the treatment of lightweight, breathable materials with a UVR-absorbing substance to produce a UV-resistant fabric which is also comfortable, particularly in warm weather.

2. Description of the Prior Art

Ultraviolet radiation (UV) resistant fabrics are known in the art. For example, U.S. Pat. No. 5,374,362 (McFarland, S.M., Dec. 20, 1994) discloses a UV-resistant formula for treating vinyl or leather comprising, as the UV-resistance providing compound, 2-(2H-benzotriazole-2-yl)-6-(dodecyl)-4-methylphenol, bis(1,2,2,6,6-pentamethyl-4-piperidinyl)sebacate, 2-(2'-hydroxy-3',5'-di-tert-amylphenyl)benzotriazole or beta-(3-(2H-benzotriazole-2-yl)-4-hydroxy-5-tert-butylphenyl)propionic acid methyl ester.

U.S. Pat. No. 5,458,956 (Shi, L., et al., Oct. 17, 1995) discloses a UV-resistant tent fabric manufactured from woven polyethylenenaphthalatebibenzoate yarns.

BRIEF SUMMARY OF THE INVENTION

The present invention is concerned with articles of clothing which have enhanced ultraviolet radiation absorption for protecting the wearer from the deleterious effects of ultraviolet radiation, and more specifically to articles of clothing which have been treated with anthraquinone, melanin or combinations thereof.

A primary object of the present invention is to provide an article of clothing which provides enhanced protection from ultraviolet radiation (200–400 nm).

Another object of the present invention is to provide an article of clothing which provides enhanced protection from both UVA and UVB radiation.

An additional object of the present invention is to provide a UV-resistant article of clothing which is lightweight and comfortable in hot temperatures.

Another object of the present invention is to provide UV-resistant article of clothing which retains its UV-resistant capabilities after washing.

A further object of the present invention is to provide UV-resistant article of clothing which is economical in cost to manufacture.

The foregoing and other objects, advantages and characterizing features will become apparent from the following description of certain illustrative embodiments of the invention.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings. Attention is called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DETAILED DESCRIPTION OF THE PREFERRED EMBODIMENTS

Figure 1:
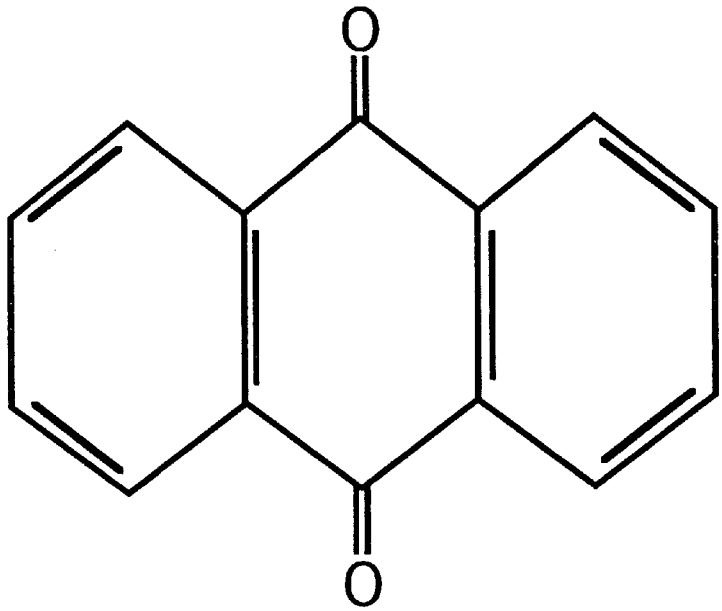
FIG. 1 is the chemical structure for anthraquinone, a preferred UV protectant of the present invention.

Turning now descriptively to the drawings, in which similar reference characters denote similar elements throughout the several views, the Figures illustrate a UV protective fabric. With regard to the reference numerals used, the following numbering is used throughout the various drawing figures.

10 the chemical structure of anthraquinone

12 the IUPAC name for 10

14 the chemical formula for 10

16 the molecular weight of 10

18 the water soluble reduction product from 10

20 two preferred reagent combinations for the reduction reaction of 10 to 18

22 the preferred reaction conditions for the oxidation reaction of 18 back to 10

24 the chemical structure of tyrosine

26 the IUPAC name for 24

28 the generic name for 24

30 the chemical formula for 24

32 the molecular weight of 24

34 the chemical structure of 5,6-dihydroxyindole

36 the IUPAC name for 34

38 the chemical formula for 34

40 the molecular weight of 34

42 the chemical structure of cysteine

44 the IUPAC name for 42

46 the generic name for 42

48 the chemical formula for 42

50 the molecular weight of 42

52 the chemical structure of 1,8-dihydroxynaphthalene

54 the IUPAC name for 52

56 the chemical formula for 52

58 the molecular weight of 52

60 the preferred whitening agent

62 an aqueous solution of anthraquinone and NaOH is prepared

64 the fabric to be treated is added to the solution of anthraquinone and NaOH in water prepared in 62

66 the fabric/solution of 64 is heated

68 sodium dithionite is added to the heated solution 66

70 the treated fabric is rinsed with $H_2O_2$

72 if necessary, the treated fabric is whitened with an appropriate whitening agent such as 60

Figure 2:
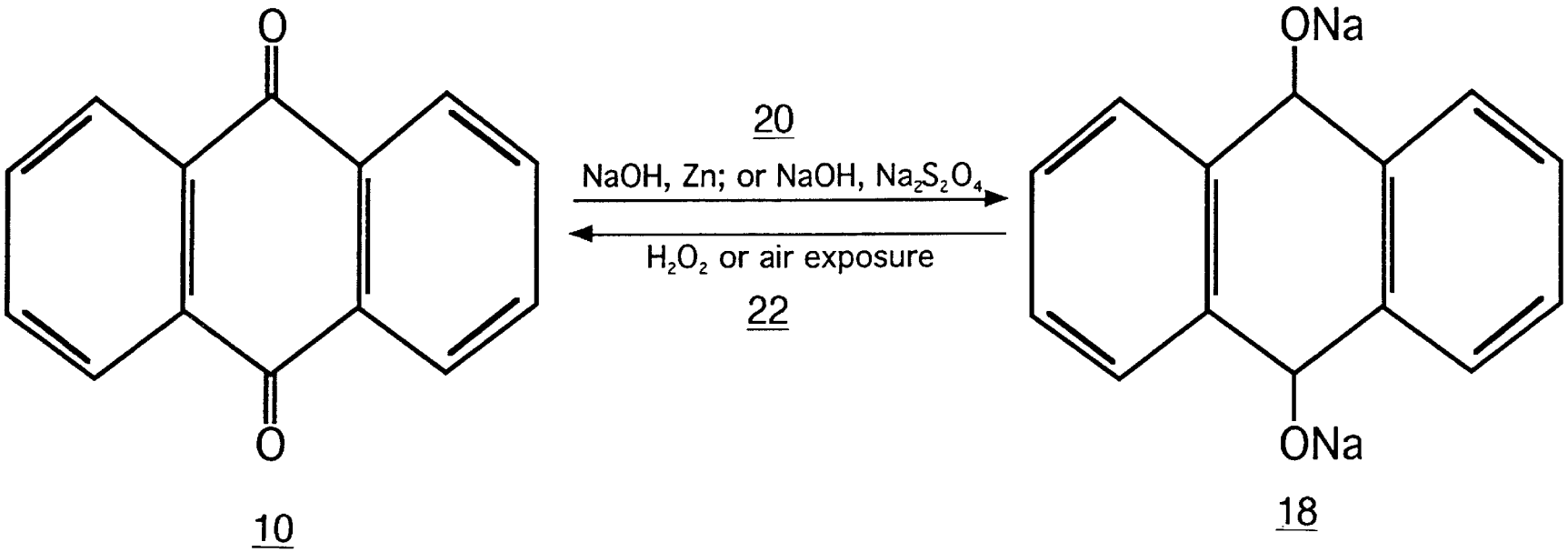
FIG. 2 illustrates the reduction/oxidation reaction which allows the anthraquinone to penetrate and bond to the fabric in the present invention.

The present invention concerns the manufacture of an article of ultraviolet radiation-resistant clothing comprising a UV-resistant amount of anthraquinone (10), illustrated in FIG. 1, bonded water-resistantly to fibers of said article. Anthraquinone (10) possesses excellent UV absorption characteristics, thereby imparting UV-resistance to the clothing of the invention. As anthraquinone (10) is insoluble in water, however, the present invention utilizes the oxidation/reduction reaction shown in FIG. 2 to disperse anthraquinone (10) throughout the clothing being treated. This procedure relies on the fact that the reduction product (18) is water soluble, allowing it to fully penetrate through the fibers of the fabric being treated. When the corresponding oxidation (22) reaction, shown in FIG. 2, occurs, the anthraquinone (10) solidifies to the fibers with a very tough, water-insoluble bond.

Figure 8:
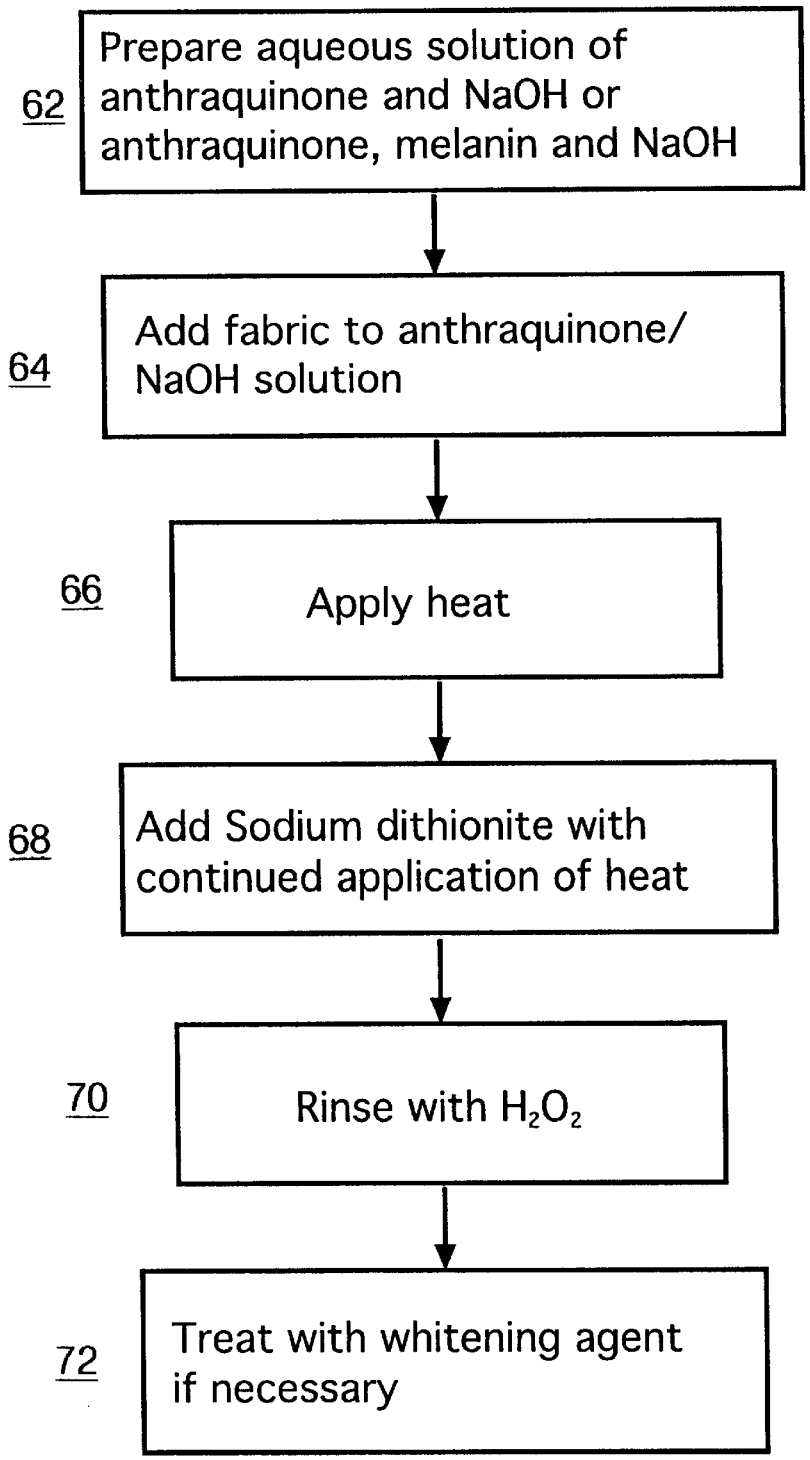
FIG. 8 is a flowchart diagram illustrating the basic steps for preparing a fabric of the present invention.

As illustrated in FIG. 8, the reaction preferably includes 1) preparing an aqueous solution of anthraquinone (10) and NaOH (62), 2) immersing the fabric to be treated in the solution (64), 3) heating the solution/fabric mixture (66), 4) adding to the solution/fabric mixture an appropriate reducing agent (68), and 5) rinsing the fabric thus treated with hydrogen peroxide (70).

With regard to step 1, preparing the aqueous anthraquinone solution (62), it is anticipated that, for each kilogram of fabric to be treated, the solution comprises from about 1 to about 9 liters of water, from about 2 to about 18 g sodium hydroxide (NaOH), and from about 10 to about 200 g anthraquinone (10). A more preferred range is from about 2 to about 4 liters of water, from about 4 to about 9 g NaOH, and from about 25 to about 100 g anthraquinone (10), with a particularly preferred composition being about 3 liters of water, about 5 g NaOH, and about 50 g anthraquinone (10) for each kilogram of fabric.

With regard to step 2, immersing the fabric to be treated in the solution (64), it is noted that this step can take place any time prior to step 5 (70), as long as the fabric is in the solution while the anthraquinone (10) is in its water-soluble form (18).

It is preferred that the solution be heated (66), in step 3, to a temperature of at least 45° C., preferably to a temperature of about 60° C.

Step 4, the addition of an appropriate reducing agent (68), provides suitable reaction conditions for the conversion of the anthraquinone (10) to its water-soluble form (18). The selection of the particular auxiliary agents (20, 22) will follow standard chemical practice. Examples include sodium dithionite, zinc, hydrogen peroxide and the aforementioned sodium hydroxide. With regard to the use of sodium dithionite, also known informally as sodium hydrosulfite or sodium sulfite, suitable reducing agent amounts can vary greatly. A suitable range is expected to be from about 1 to about 50 g, preferably about 5 to about 25 g, per kilogram fabric being treated. It is anticipated that the addition of sodium dithionite can be most effectively accomplished by addition to the reaction in a series of portions. One preferred procedure comprises adding several sequential portions to the reaction mixture over the course of 15 to 45 minutes. A total time of reaction can generally be from about 30 to about 90 minutes, with a total reaction time of about 60 minutes preferred. By reaction time it is meant the time that the fabric is in contact with the heated solution while the anthraquinone is in its water-soluble form.

Step 5, rinsing the fabric with hydrogen peroxide ($H_2O_2$) (70), acts to oxidize the reduced anthraquinone back to its water-insoluble form, thereby forming a durable bond to and throughout the fabric being treated. This step can be accomplished via other methods, such as, for example, air drying, but the use of a peroxide rinse (70) is preferred.

Figure 7:
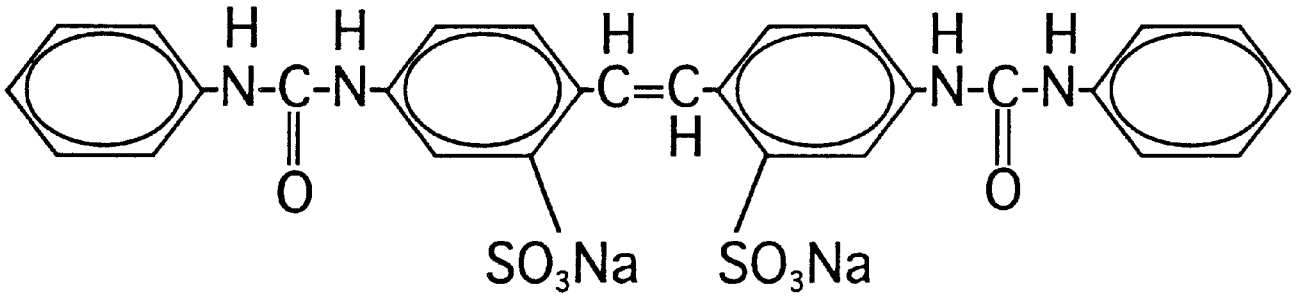
FIG. 7 is the chemical structure for a preferred whitening agent of the present invention.

For white fabrics, it is possible that the anthraquinone treatment described above will result in some discoloration of the fabric, such as a slightly yellowish tinge. If this occurs, the fabric can be treated (72) with a conventional bleaching, or whitening, agent. A preferred whitening agent is shown in FIG. 7 (60). The reaction conditions for the bleaching process generally include a pH of about 9 to 10 and the addition of $Na_3PO_4$ as an auxiliary agent.

For colored fabrics, it is preferred to add an additional UV-absorbing compound, melanin. Melanin refers to a class of readily synthesized biopolymers which act as pigments in humans and other animals. As polymers derived from monomers having several reactive sites, these compounds tend to be heterogeneous, irregular and poorly characterized. It is most common to define melanins in terms of their precursor monomers. There are generally considered to be three major classes of melanins, all of which are within the scope of the invention.

Figure 3:
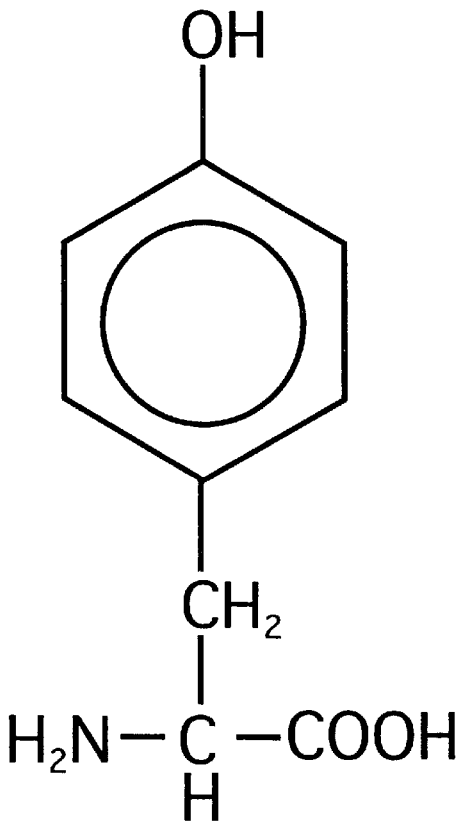
FIG. 3 is the chemical structure for tyrosine, the primary precursor molecule for the the preferred melanin of the present invention.
Figure 4:
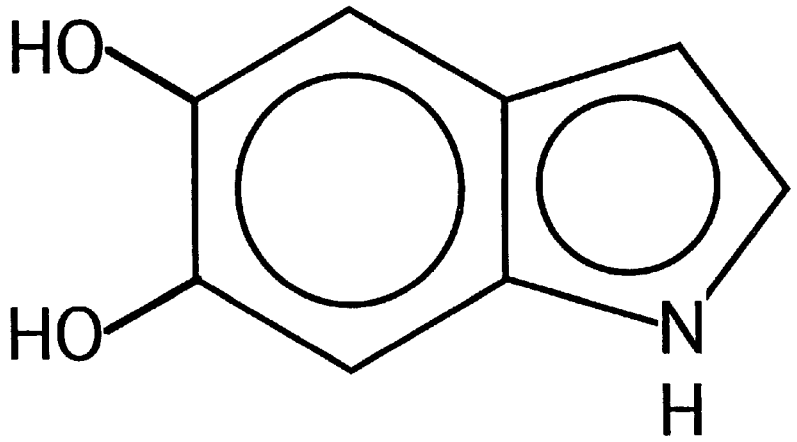
FIG. 4 is the chemical structure for 5,6-dihydroxyindole, a melanin precursor.

The first class of melanins comprises those derived from the precursor amino acid tyrosine (24), shown in FIG. 3. A preferred melanin is that formed from the free radical polymerization of 5,6-dihydroxyindole (34), shown in FIG. 4, which is, in turn, produced from tyrosine (24). Other tyrosine-derived precursor monomers suitable for use in the invention include dihydroxyphenylalanine (dopa), phenylalanine-3,4-quinone (dopaquinone), 5,6-dihydroxyindole-2-carboxylic acid, dopamine, tryptamine, 5-hydroxytryptamine (serotonin), epinephrine (adrenaline) and norepinephrine (noradrenaline). All of the tyrosine-derived melanins are preferred.

Figure 5:
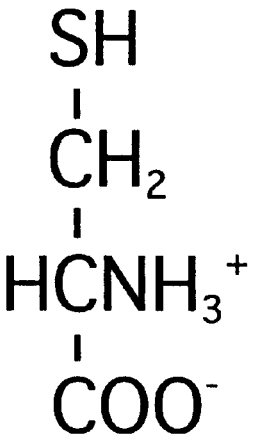
FIG. 5 is the chemical structure for cysteine, e.g., amino-3-mercaptopropanoic acid, another melanin precursor.

The second class of melanins are sulfur-containing polymers derived from a combination of tyrosine (24) and cysteine (42), shown in FIG. 5. Of these, one species has been accurately characterized as having the chemical formula $C_{77}H_{98}O_{33}N_{14}S$ and a molecular weight of 1780. Generally speaking, however, this class of melanins is characterized in terms of their precursor molecules also.

Figure 6:
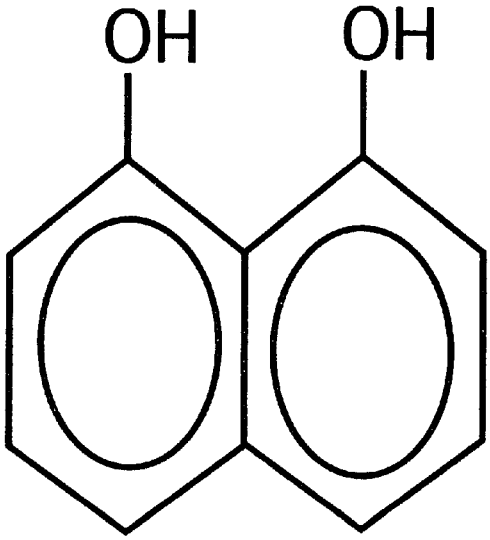
FIG. 6 is the chemical structure for 1,8-dihydroxynaphthalene, a further melanin precursor.

The third class of melanins are those formed from nitrogen-free precursors, for example, 1,8-dihydroxynaphthalene (52), shown in FIG. 6.

For each kilogram of fabric being treated, it is expected that the solution contain from about 1 to about 1000 grams of melanin, preferably from about 10 to about 100 grams.

It will be understood that each of the elements described above, or two or more together, may also find a useful application in other types of applications differing from the type described above. While the invention has been illustrated and described as embodied in a UV-resistant article and a method of making same, it is not intended to be limited to the details shown, since it will be understood that various omissions, modifications, substitutions and changes in the forms and details of the formulation illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of this invention.

What is claimed as new and desired to be protected by Letters Patent is set forth in the appended claims:

1. A process for increasing the ultraviolet radiation resistance of fabric comprising the steps:

a) preparing an aqueous solution of anthraquinone and NaOH;

b) immersing said fabric in said solution;

c) heating said solution;

d) adding to said solution an effective amount of a reducing agent selected from sodium dithionite and zinc; and e) rinsing said fabric with hydrogen peroxide.

2. A process as defined in claim 1 wherein said reducing agent is sodium dithionite.

3. A process as defined in claim 1, further comprising the step of cooling said solution after said reducing agent has been added.

4. A process as defined in claim 3, further comprising the step of treating said fabric with a whitening agent after said rinsing.

5. A process as defined in claim 4, wherein said whitening agent has the chemical structure

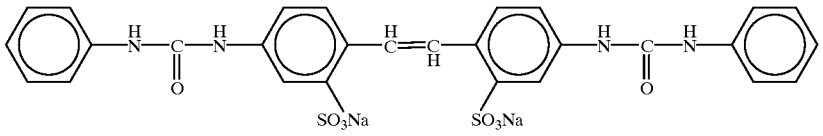

6. A process as defined in claim 1, wherein said solution further includes melanin.

7. A process as defined in claim 6, wherein said melanin is the free radical polymerization product of tyrosine, 5,6-dihydroxyindole, dihydroxyphenylalanine, phenylalanine-3,4-quinone, 5,6-dihydroxyindole-2-carboxylic acid, dopamine, tryptamine, 5-hydroxytryptamine, epinephrine, norepinephrine or 1,8-dihydroxynaphthalene.

8. A process defined in claim 7, wherein said melanin is the free radical polymerization product of 5,6-dihydroxyindole.

9. A process as defined in claim 6, wherein said melanin is the free radical polymerization product of tyrosine and cysteine.

10. A process as defined in claim 6, wherein said melanin has the chemical formula $C_{77}H_{98}O_{33}N_{14}S$.

11. A process as defined in claim 1, wherein, for each kilogram of fabric, said solution comprises from about 1 to about 9 liters of water, from about 2 to about 18 g NaOH, and from about 10 to about 200 g anthraquinone.

12. A process as defined in claim 11, wherein, for each kilogram of fabric, said solution comprises from about 2 to about 4 liters of water, from about 4 to about 9 g NaOH, and from about 25 to about 100 g anthraquinone.

13. A process as defined in claim 12, wherein, for each kilogram of fabric, said solution comprises about 3 liters of water, about 5 g NaOH, and about 50 g anthraquinone.

14. A process as defined in claim 6, wherein, for each kilogram of fabric, said solution comprises from about 1 to about 9 liters of water, from about 2 to about 18 g NaOH, and from about 10 to about 200 g anthraquinone.

15. A process as defined in claim 14, wherein, for each kilogram of fabric, said solution comprises from about 2 to about 4 liters of water, from about 4 to about 9 g NAOH, and from about 25 to about 100 g anthraquinone.

16. A process as defined in claim 15, wherein, for each kilogram of fabric, said solution comprises about 3 liters of water, about 5 g NaOH, and about 50 g anthraquinone.

17. A process as defined in claim 6, wherein, for each kilogram of fabric, said solution comprises from about 1 to about 1000 g of melanin.

18. A process as defined in claim 17, wherein, for each kilogram of fabric, said solution comprises from about 10 to about 100 g of melanin.

19. A process as defined in claim 15, wherein, for each kilogram of fabric, said solution comprises from about 1 to about 1000 g of melanin.

20. A process as defined in claim 19, wherein, for each kilogram of fabric, said solution comprises from about 10 to about 100 g of melanin.

21. A process as defined in claim 20, further comprising the step of cooling said solution after said reducing agent has been added.

22. A process as defined in claim 21, further comprising the step of treating said fabric with a whitening agent after said rinsing.

23. A process as defined in claim 22, wherein said whitening agent has the chemical structure

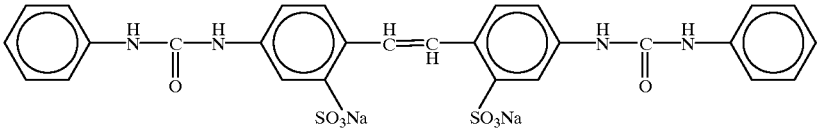

24. A process as defined in claim 23 wherein said reducing agent is sodium dithionite.

25. A process as defined in claim 1 wherein said solution is heated to a temperature of at least 45° C.

26. A process as defined in claim 25 wherein said solution is heated to a temperature of about 60° C.

27. A fabric produced according to the process defined in claim 1.

28. A fabric produced according to the process defined in claim 26.

29. An article of clothing made from the fabric defined in claim 27.

30. An article of clothing made from the fabric defined in claim 28.

* * * * *